US006191757B1

(12) United States Patent
Bassily et al.

(10) Patent No.: US 6,191,757 B1
(45) Date of Patent: Feb. 20, 2001

(54) SYSTEM FOR COMPACT STOWAGE OF SEGMENTED DISH REFLECTORS

(75) Inventors: Samir F. Bassily, Los Angeles; John Ziavras, Hermosa Beach, both of CA (US)

(73) Assignee: Hughes Electronics Corporation, El Segundo, CA (US)

( * ) Notice: Under 35 U.S.C. 154(b), the term of this patent shall be extended for 0 days.

(21) Appl. No.: 09/288,474

(22) Filed: Apr. 8, 1999

(51) Int. Cl.[7] ..... H01Q 15/20
(52) U.S. Cl. ..... 343/915; 343/916; 343/912
(58) Field of Search ..... 343/915, 912, 343/916, DIG. 2

(56) References Cited

U.S. PATENT DOCUMENTS 3,717,879 * 2/1973 Ganssle ..... 343/915
4,529,277 * 7/1985 Gee et al. ..... 350/613
4,780,726 * 10/1988 Archer et al. ..... 343/881
5,969,695 * 10/1999 Bassily et al. ..... 343/915
6,028,569 * 2/2000 Bassily et al. ..... 343/915

* cited by examiner

*Primary Examiner*—Hoanganh Le
*Assistant Examiner*—Trinh Vo Dinh
(74) *Attorney, Agent, or Firm*—T. Gudmestad

(57) ABSTRACT

A deployable segmented dish-like reflector includes a main body with one or more additional reflector segments. Each reflector segment is connected to the main body with one or more link members, such that the entire reflector may be stowed into a compact volume and subsequently deployed to its operational configuration. The system provides a mechanism for stowing the at least one segment in an overlapping manner, substantially parallel to the main body, in order to minimize its stowage volume. The linkage arrangement allows the at least one reflector segment to be deployed from the stowed position to a desired final position. Rate control and deployment coordination may be introduced in a variety of ways.

19 Claims, 7 Drawing Sheets

SYSTEM FOR COMPACT STOWAGE OF SEGMENTED DISH REFLECTORS

TECHNICAL FIELD

The present invention relates to a system for stowing and deploying a segmented dish-like structure, such as a spacecraft/satellite antenna reflector. More particularly, the present invention relates to a unique system for stowing a segmented dish-like structure compactly yet allowing for relatively uncomplicated deployment thereof.

BACKGROUNF ART

Currently, there are three main types of deployable reflectors. The first type of deployable reflectors are mesh or membrane reflectors that include a tensioned mesh or metalized membrane supported by relatively stiff, foldable or collapsible ribs. When the ribs are in their unfolded or extended position, the mesh or membrane forms the reflecting surface of this type of reflector. Examples of this type of reflectors include the Astro Mesh reflector designed by Astro Aerospace, the wrapped rib design manufactured by Lockheed Martin, and the TDRS reflector designed by Harris. While these reflectors have a lower stowage volume, they have relatively poor surface accuracy.

The second type of deployable reflectors are semi-rigid shell reflectors. These reflectors have one or more relatively thin flexible shells which form the reflector surfaces. In operation, the shells are folded and/or strained in either the stowed or deployed configuration. Hughes Space and Communications' Springback, Harris' Concentrator, and Loral's Furlable are examples of this type of deployable reflectors. The semirigid shell reflectors generally provide better surface accuracy then the mesh reflectors, however they require larger stowage volumes which is undesirable.

The third type of deployable reflectors are segmented rigid surface reflectors. These reflectors consist of two or more rigid curved surface segments that are hinged together. Examples of this type of reflector, include Hughes Space and Communications' BSB reflector, TRW's rigid collapsible dish, and Dorneir's collapsible reflectors. If the number of segments can be minimized, this type of reflector can typically provide excellent surface accuracy. However, when this type of reflector is divided into a number of segments, the segments which are connected directly to an adjoining segment are difficult to fold and stow compactly because of their surface curvature. Thus, while the segmented rigid surface reflectors provide good surface accuracy, they currently require the largest stowage volume.

SUMMARY OF THE INVENTION

It is therefore an object of the present invention to provide a system for folding a segmented rigid surface reflector that requires a lower stowage volume for a given overall size and number of segments.

It is a further object of the present invention to provide a system for folding a segmented rigid surface reflector through the use of one or more links that interconnect the individual segments.

In accordance with the objects of the present invention, a system for stowing and deploying a segmented dish-like structure is provided. The system includes a main body segment having a front surface and a rear surface. The main body segment is alignable with at least one additional segment to form a dish-like structure when in its deployed position. The at least one additional segment has a front surface and a rear surface. The at least one additional segment is moveable into a stowed position and out of alignment with the main body segment by at least one link member which is hingeably attached to the main body segment and the at least one additional segment. When the system is in a stowed positions the front surface of the main body segment is positioned generally parallel with respect to the front surface of the at least one additional segment. Further, the at least one link member is stowed in between the main body segment and the at least one additional segment when the dish-like structure is in a stowed position.

Additional advantages and features of the present invention will become apparent from the description that follows, and may be realized by means of the instrumentalities and combinations particularly pointed out in the appended claims, when taken in conjunction with the accompanying drawings.

BRIEF DESCRIPTION OF THE DRAWINGS

FIG. 2(*b*) is a view along Arrow 2B of the segmented reflector of FIG. 2(*a*);

FIGS. 2(*c*)–(*e*) illustrates various stages of the deployment of the segmented reflector of FIGS. 2(*a*) and 2(*b*);

FIG. 11(*b*) is a schematic representation of a sectional side view of the linkage along the arrow A shown in FIG. 11(*a*)

BEST MODES FOR CARRYING OUT THE INVENTION

Figure 1:
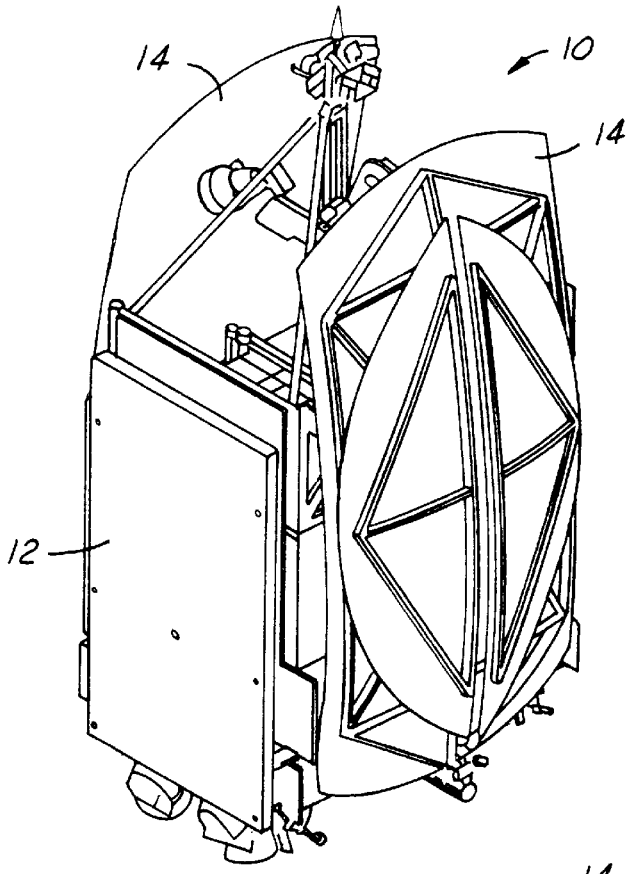
FIG. 1 is a perspective view of a segmented reflector in a stowed position in accordance with a preferred embodiment of the present invention.

FIG. 1 illustrates a satellite 10 having a pair of solar panels 12 and a pair of segmented antenna reflectors 14. The satellite 10 is shown in a stowed position with the pair of solar panels 12 and the pair of segmented antenna reflectors 14 in a stowed position. The present invention, as discussed in detail below, relates to the stowage and deployment of the segmented antenna reflectors 14. The invention as described below and as shown in the drawings, is not limited solely to segmented antenna reflectors, but may be applied to any segmented dish-like structure, such as solar concentrators and other segmented foldable structures.

As shown in the Figures, each reflector 14 includes a main body 16 and at least one segment 18 which, when deployed, together form a reflector surface. Each segment 18 is connected to the main body 16 by one or more link members 20, such that the entire reflector 14 may be stowed in a compact volume and subsequently deployed to its operational configuration. The system provides a mechanism for stowing the segments 18 in an overlapping manner, i.e., in front of or behind the main body 16. The segments 18 are also preferably stowed such that they are substantially parallel to the main body 16 (with their respective curved surfaces aligned) in order to minimize the stowage volume and/or minimize the number of segments 18 required to stow the reflector in a given envelope 29.

The link members 20 provide a mechanism of deploying the reflector segment(s) such that they are displaced from the stowed position to a desired final position. The number and type of link members 20 utilized can vary as discussed below. In the preferred embodiments, the segments may be deployed as an open kinematic chain. Some embodiments may, alternatively, use a linkage that coordinates relative motion of the joints. Moreover, rate control may be incorporated in one or more joints though various devices such as dampers or brakes, as are well known in the art.

The reflector 14, shown in FIGS. 2(*a*) through 2(*e*) has a main body 16, a single reflector segment 18, and a single link member 20 which deploy as an open kinematic chain. As shown in FIGS. 2(*a*) and 2(*b*), the reflector segment 18 is stowed rearwardly of, and generally parallel to, the main body 16. The link member 20 has a first hinge 22 attached to the main body 16 and a second hinge 24 attached to the reflector segment 18 at an edge 26. The link member 20 is disposed between the reflector segment 18 and the main body 16 in the stowed position. The stowed reflector fits within a specified envelope 29.

FIGS. 2(*c*) through 2(*e*) illustrate the deployment process of the reflector 14 of FIGS. 2(*a*) and 2(*b*). First, the reflector segment 18 is pivoted about the second hinge 24 so that the segment 18 is unfolded away from the main body 18, as shown in FIG. 2(*c*). The segment 18 is then pivoted about the first hinge 22 until it is brought into communication with a peripheral edge 28 of the main body 16 to form a full reflector 14, as shown in FIG. 2(*e*). In the fully deployed position, the link member 20 has been pivoted such that the second hinge 24 is positioned at the junction between the reflector edge 26 and the peripheral edge 26, as represented by 24' in the FIG. 2(*a*), Further, a curved outer peripheral edge 32 of the segment 18 is deployed into a position as represented by the dashed line 30. This deployment sequence is one of many possibilities. It may be achieved by selectively introducing a differing degree of damping or other rate limits at the first hinge 22 relative to the second hinge 24 or by a delayed release of the link member 20.

Figure 3:
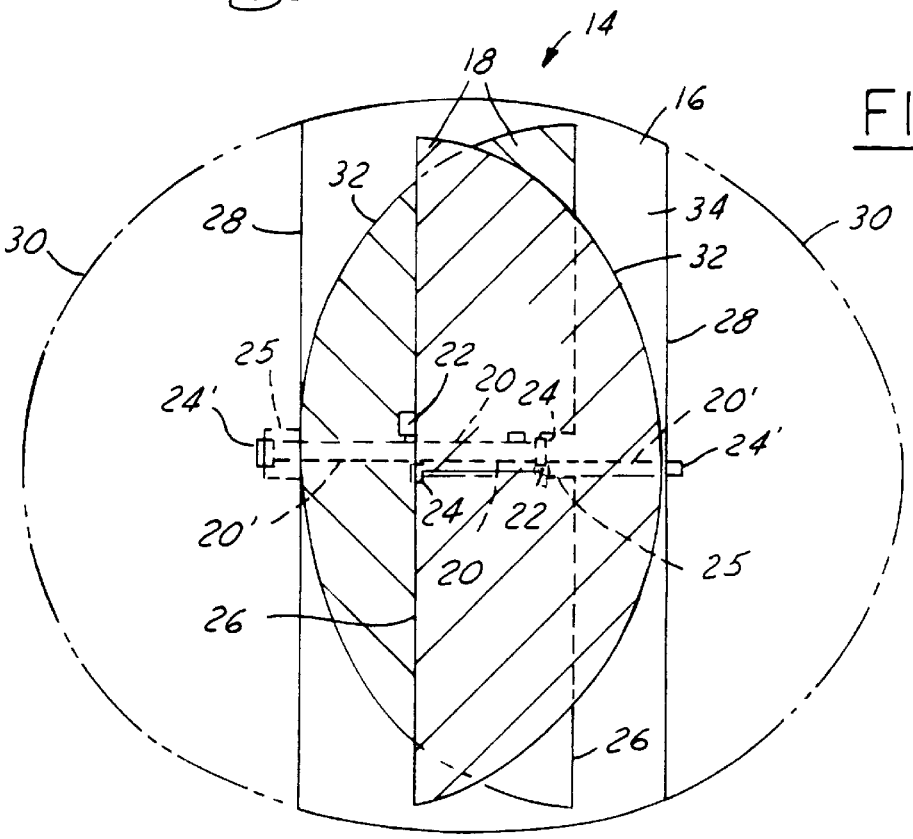
FIG. 3 is a rear view of a segmented reflector in a stowed position with the two segments overlapping one another in accordance with a preferred embodiment of the present invention.
Figure 2A:
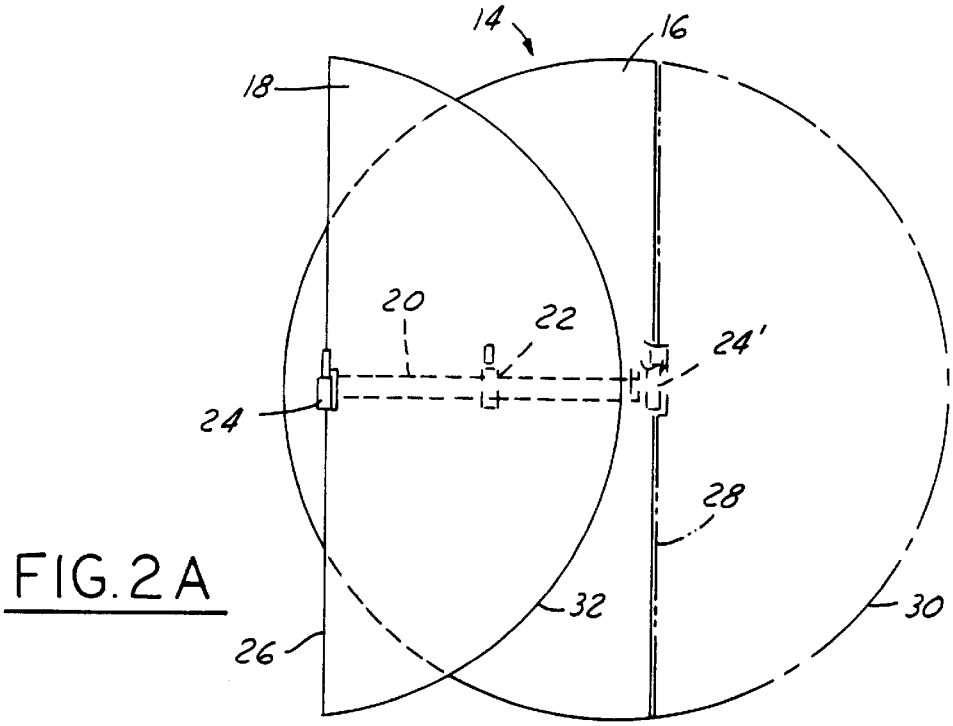
FIG. 2 (*a*) is a rear view of a segmented reflector in a stowed position having a single reflector segment in accordance with a preferred embodiment of the present invention.
Figure 2B:
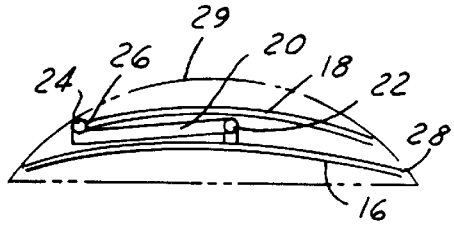
Figure 2C:
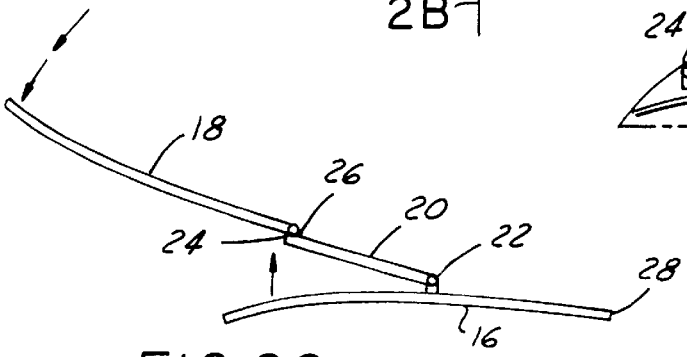
Figure 2D:
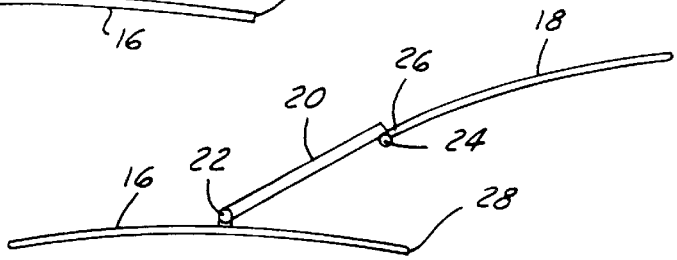
Figure 2E:
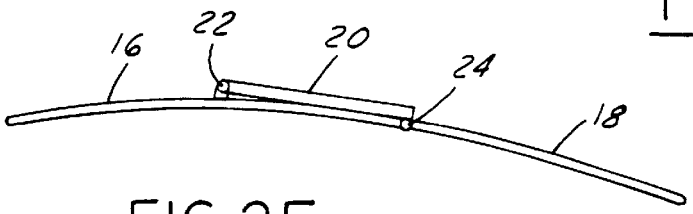
Figure 4:
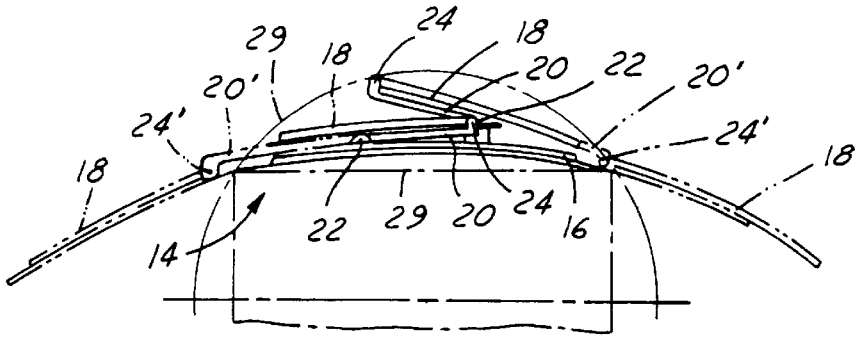
FIG. 4 is a bottom view of a segmented reflector of FIG. 3.

FIGS. 3 and 4 illustrate another preferred embodiment of a segmented reflector 14. In this embodiment, the segmented reflector 14 has a main body 16 and two reflector segments 18. When the reflector segments 18 are in their deployed positions, they form a functioning reflector, as represented by the dashed line 30. Each reflector segment 18 is generally crescent-shaped and has a curved outer periphery 32 and an inner edge 26. The curved outer periphery 32 coincides with the dashed line 30 when deployed, while the inner edge 26 is alignable with a respective edge 28 of the main body 16. In the stowed position, the reflector segments 18 are overlapping as shown in FIGS. 3 and 4. By overlapping the segments 18 in this fashion, a reflector 14 having a larger surface area than that of the reflectors shown in FIG. 1 or 2 can be stowed within the same cylindrical envelope used to stow the satellite in FIG. 1 or the envelope 29 used to stow the reflector of FIG. 2.

Each segment 18 has a single link member 20 for communicating the segments 18 between a stowed and a deployed position. Each link member 20 has a first hinge 22 where it is attached to a rear surface 34 of the main body 16 and a second hinge 24 where the link member 20 is attached to the edge 26 of the segment 18. The link members 20 rotate about the first and second hinges 22, 24 to deploy the segments 18 to the position represented by the dashed lines 30 in FIGS. 3 and 4. In the deployment sequence, the edges 26 are moved into alignment with the edges 28 of the main body 16, such that a fully operational reflector 14 is formed. In the deployed position, the link members 20' are pivoted such that the second hinge 24' is positioned as shown in FIGS. 3 and 4. A notch 25 near the middle of the edges 26 of the segments 18 may be required in order to clear the link member 20 in this overlapping configuration. The mechanism for energizing the link members 20 can be of any conventional type and will be readily understood by one of ordinary skill in the art.

Figure 5:
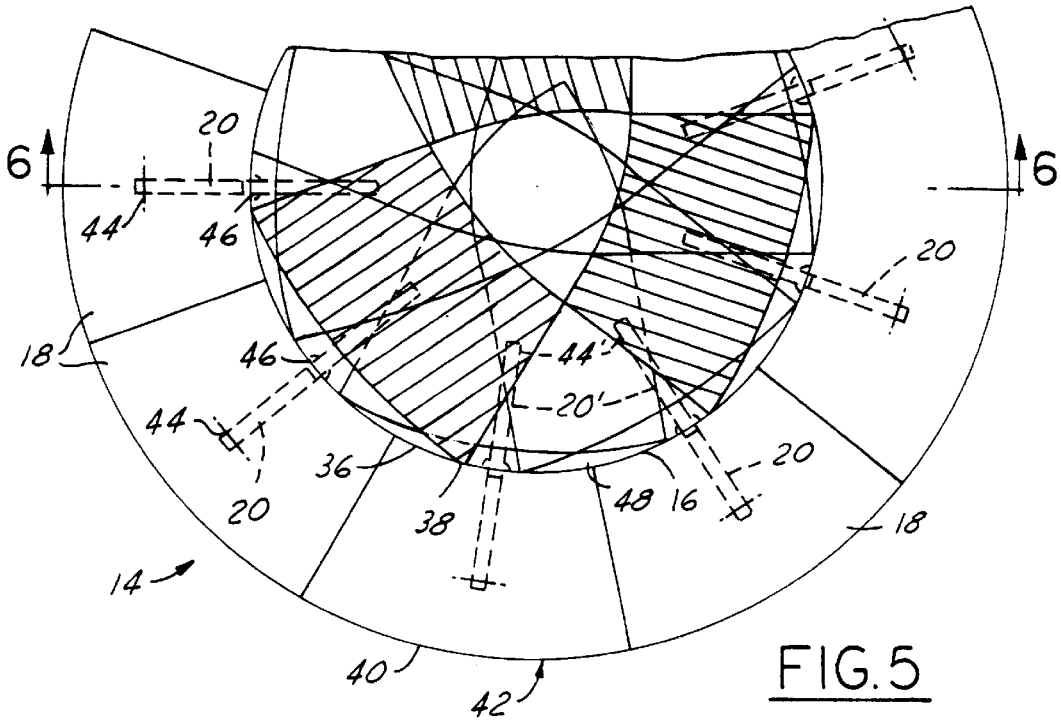
FIG. 5 is a front view of a nine-segment reflector in a deployed position in accordance with a preferred embodiment of the present invention.
Figure 6:
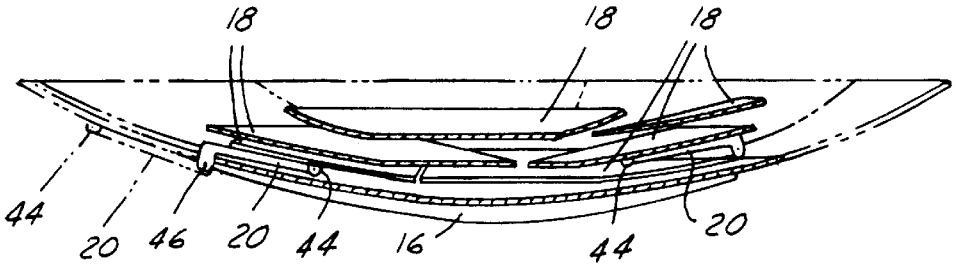
FIG. 6 is a sectional illustration of the segmented reflector of FIG. 5 along the line 6—6.

FIGS. 5 and 6 illustrate a segmented reflector 14 in accordance with another preferred embodiment. The segmented reflector 14 has a main body 16 and nine individual reflector segments 18. The reflector segments 18 each have an inner curved edge 36 that aligns with the outer periphery 38 of the main body 16 when the reflector segments are in their deployed position. In this position, the outer edge 40 of each of the segments 18 forms the outer periphery 42 of the reflector 14. Each of the segments 18 has a link member 20, with a first hinge 44 secured to its rear surface (shown in phantom in FIG. 5) and a second hinge 46, opposite the first hinge 44 that is pivotally secured to the outer edge (periphery) 38 of the main body 16.

When the reflector segments 18 are stowed, they are pivoted about their respective second hinges 46 and stowed in front of the front surface 48 of the main body 16. The segments 18 are each preferably stowed such that they lie generally parallel to the main body 16 and their curvature matches the curvature of the front surface 48 of the main body 16. The segments 18 are stowed as shown by the cross-hatched segments in FIG. 5. In this position, the second hinge 46 of the link member 20 is adjacent the outer edge 38 of the main body 16 and the first hinge 44 is disposed toward the center of the main body 16, as shown by 20' and 44'. Additionally, the reflector segments 18 are preferably stowed in an overlapping manner with their outer edges 40 adjacent to the outer periphery 38 of the main body 16. By this configuration, the overall stowage volume of the segmented reflector 14 is minimized.

Figure 7:
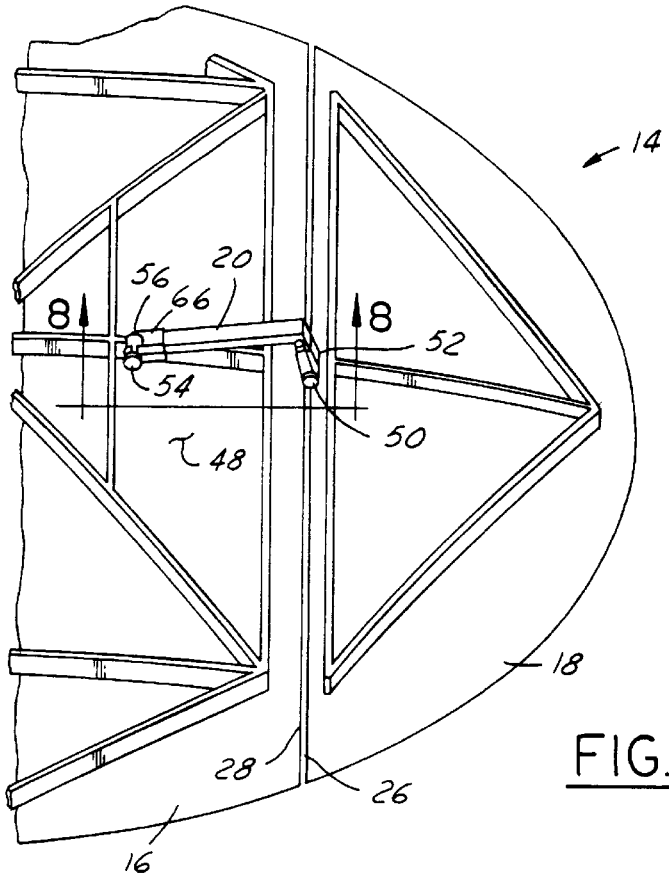
FIG. 7 is a broken away view of a segmented reflector utilizing another preferred linkage system for connecting an additional segment to a main body in accordance with the present invention.

FIG. 7 illustrates another preferred embodiment of a segmented reflector 14. The segmented reflector 14 utilizes a single link member 20 to move a reflector segment 18 with respect to the main body 16. As shown, the reflector segment 18 is in a fully deployed position with its inner edge 26 aligned with the peripheral edge 28 of the main body 16. The link member 20 is used in connection with a cable and pulleys as shown in more detail in FIG. 8. This configuration uses one link member 20, with the rotations at its two ends coordinated by a unique implementation of a four bar linkage.

Figure 8:
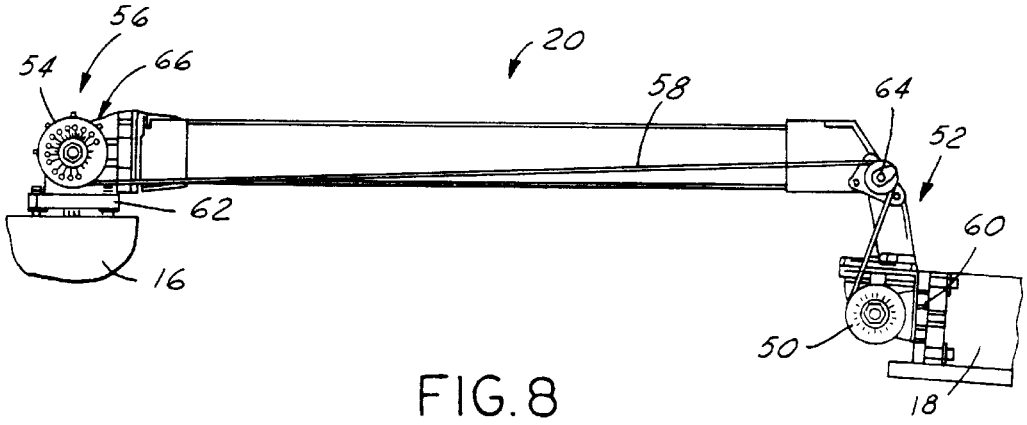
FIG. 8 is a side view of a cable and pulley linkage system in accordance with a preferred embodiment of the present invention.
Figure 9B:
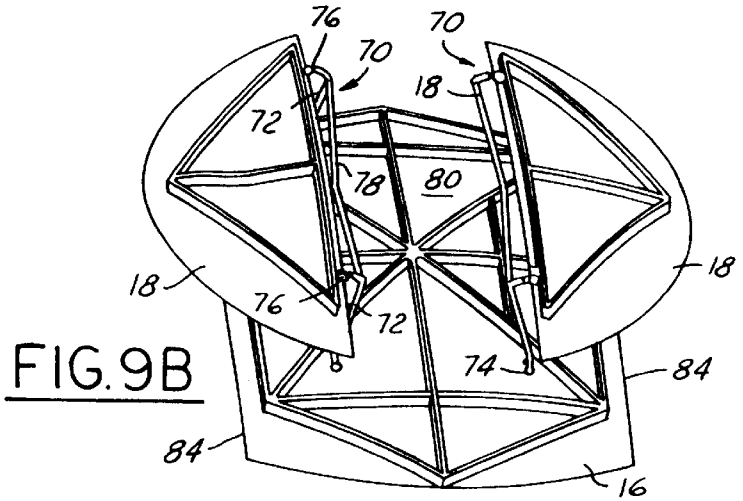
FIGS. 9 (*a*) through (*d*) illustrate a segmented reflector having a pair of link members connecting each additional segment to the main body during various stages of its deployment in accordance with a preferred embodiment of the present invention.
Figure 9D:
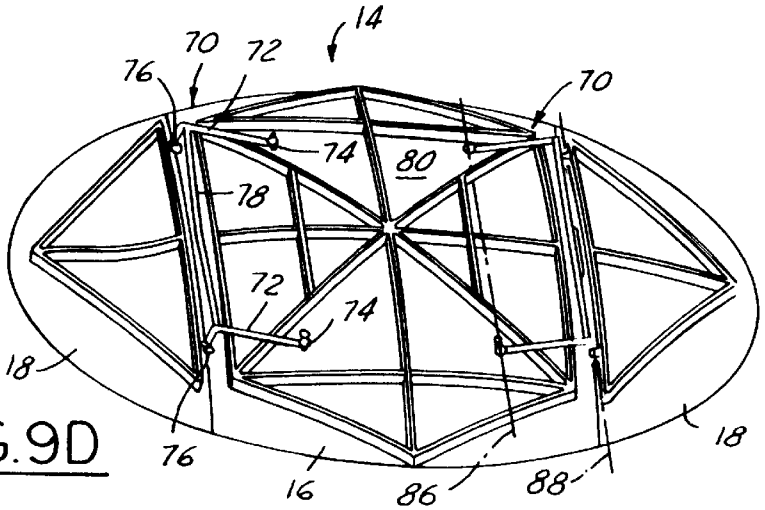
Figure 9A:
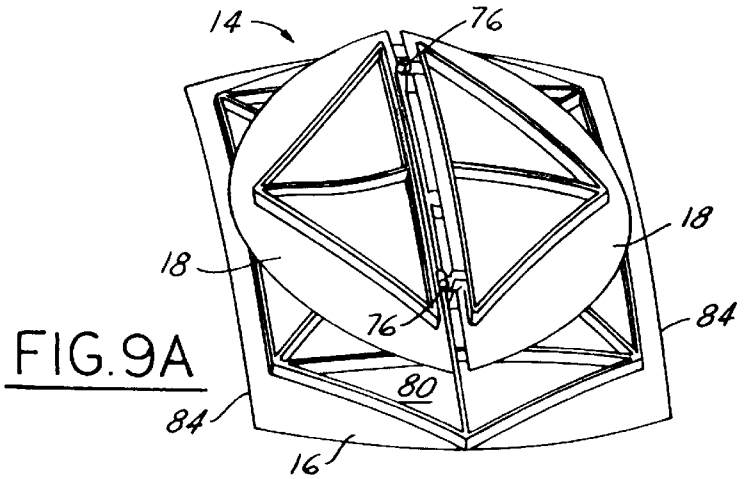
Figure 9C:
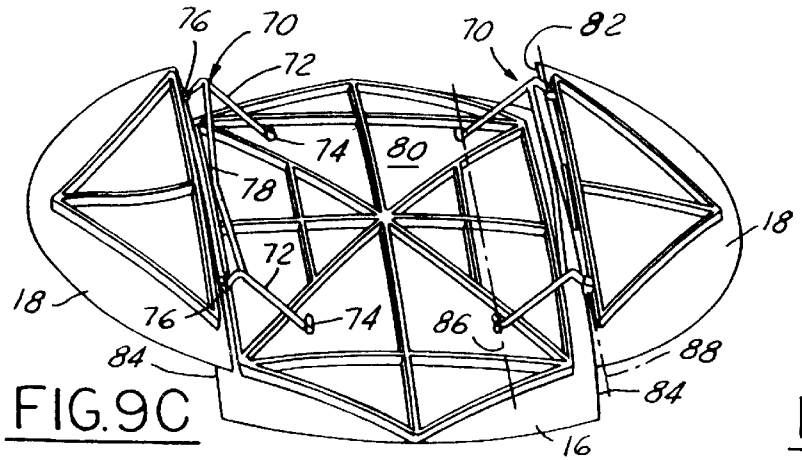

As shown in FIGS. 7 and 8, an outboard pulley 50 is located at a first end 52 of the link member 20 adjacent the edge 26 of the segment 18. An inboard pulley 54 is located at an opposing second end 56 of the link member 20 adjacent the rear surface 48 of the main body 16. The outboard pulley 50 is slightly smaller than the inboard pulley 54 so that as the deployment is completed, a cable 58 running between the two pulleys 50, 54, is rendered slack, thus decoupling the joints in the deployed position. Decoupling the joints in this manner provides better deployment repeatability and positional stability.

The outboard pulley 50 also has a segment interface 60 where the outboard pulley 50 is attached to the edge 26 of the adjoining reflector segment 18. The inboard pulley 54 has a main body interface 62 where the inboard pulley 54 is attached to the main body 16. An idler pulley 64 is positioned between the two pulleys 50 and 54 to help route the cable 58 along side the link 20 and clear from the reflector segment 18 as it moves to its stowed position. Further, a damped hinge 66 is also preferably utilized at the first end 52 of the link 20 to provide rate control. The damped hinge 66 may instead be positioned at the second end 56 or at both ends. Alternatively, coordination may be achieved by use of a connecting rod instead of the cable and pulleys.

FIGS. 9(*a*) through 9(*d*) illustrate the deployment process of a segmented reflector 14 through the utilization of an alternate link member. The segmented reflector 14 shown in FIG. 9(*a*) has two deployable reflector segments 18 and a main body 16. A frame 70, includes a pair of link members 72 pivotally connected at a first end 74 to the main body 16 and at an opposing second end 76 to one of the deployable segments 18, The frame 70 also includes a connecting torsion member 78 extending between the pair of link members 72 in order to coordinate their positions. In FIG. 9(*a*), the reflector segments 18 are shown in an almost fully stowed position with the link members 72 positioned between the rear surface 80 of the main body 16 and the segments 18.

FIG. 9(*b*) illustrates the segmented reflector 14 with the deployable segments 18 in a partially deployed position. FIG. 9(*c*) illustrates the deployable segments 18 in an almost fully deployed position and FIG. 9(*d*) illustrates the deployable segments 18 in a fully deployed position with the straight edges 82 of each of the segments 18 adjacent to a respective peripheral edge 84 of the main body 16.

Each segment 18 is deployed along two axes. The first axis 86 is positioned along a line through the first ends 74 of the link members 72 and the second axis 88 is positioned along a line through the second ends 76 of the link members 72. The second ends 76 of each of the link members 72 is positioned adjacent the edge 82 of each of the segments 18. Conventional motor or spring driven hinges actuate deployment at each joint. The deployment motion may be coordinated by the linkages formed by the main body 70, the frame 55, as well as pulleys and a cable similar to those described in connection with FIG. 8.

Figure 10:
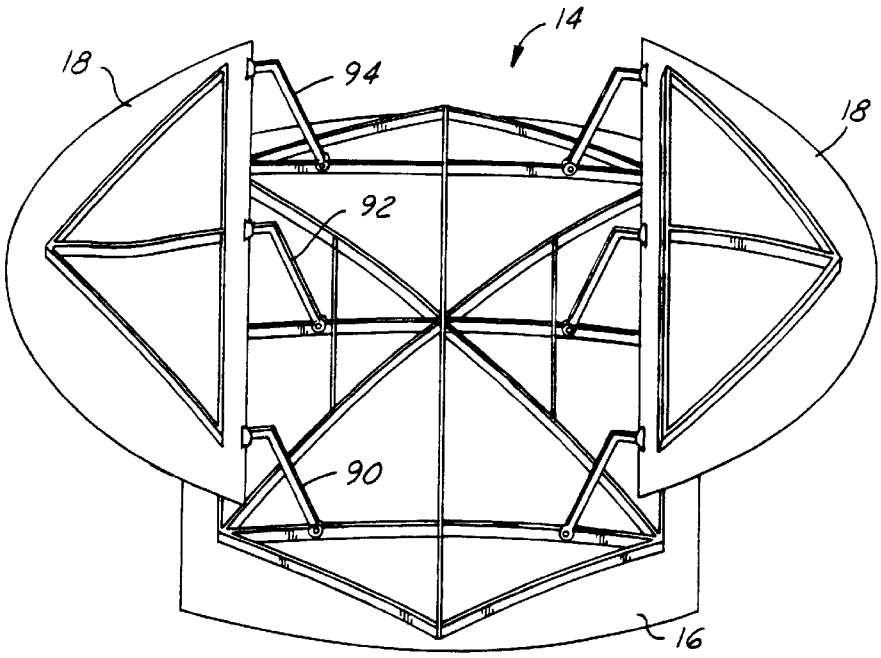
FIG. 10 is a perspective view of the segmented reflector utilizing another preferred linkage system having three link members connecting each additional segment to the main body in accordance with the present invention.
Figure 11B:
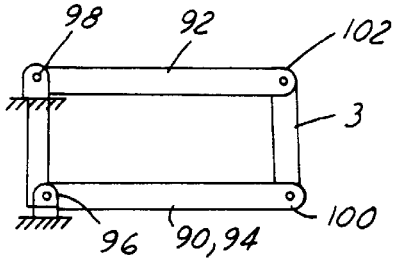
FIG. 11(*a*) is a perspective view illustrating the attachment of a linkage system to a main body and an additional segment of a segmented reflector in accordance with the preferred embodiment shown in FIG. 10.
Figure 11A:
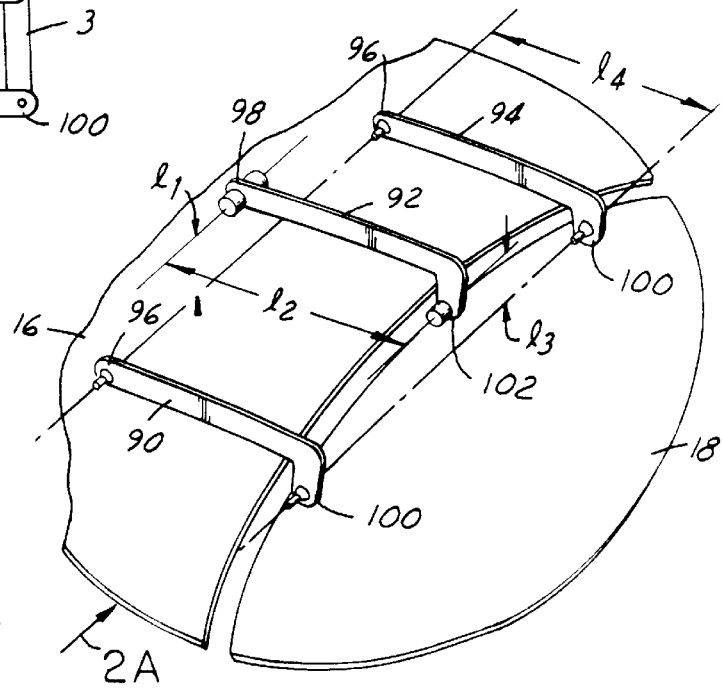
Figure 12A:
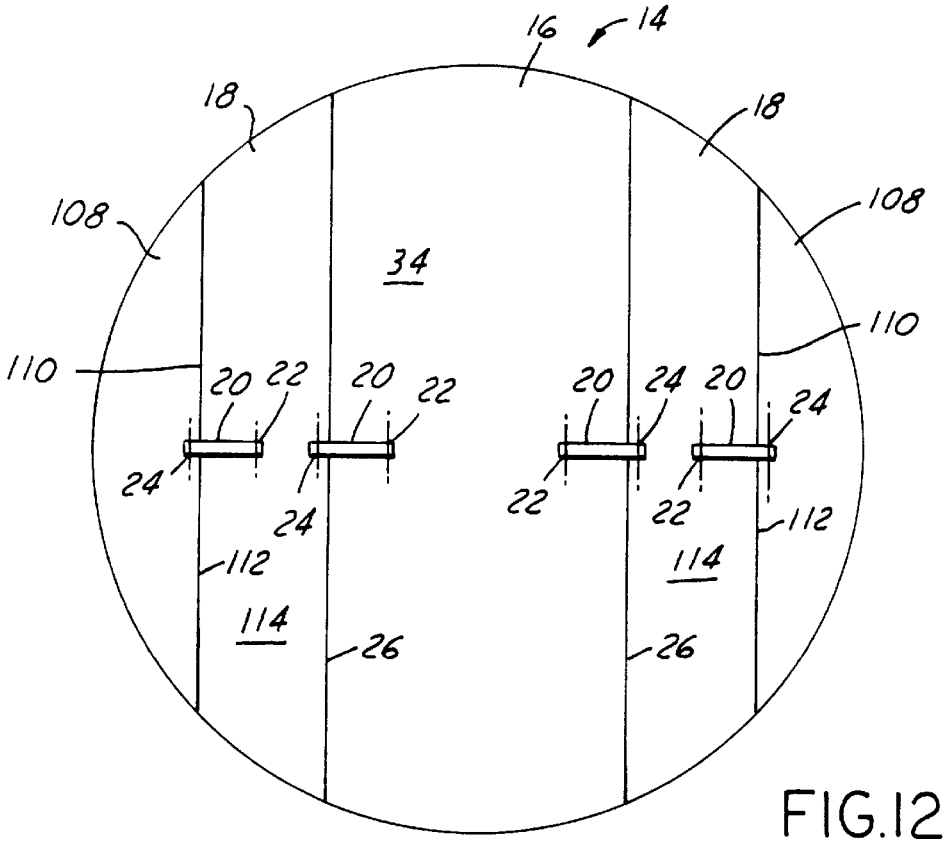
FIGS. 12(*a*) through (*d*) illustrate a segmented reflector having a pair of reflector segments daisy-chained to one another in accordance with a preferred embodiment of the present invention.
Figure 12B:
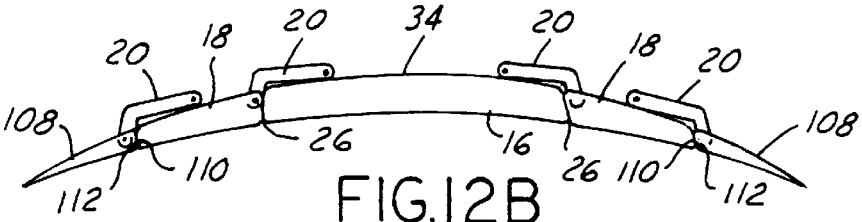
Figure 12C:
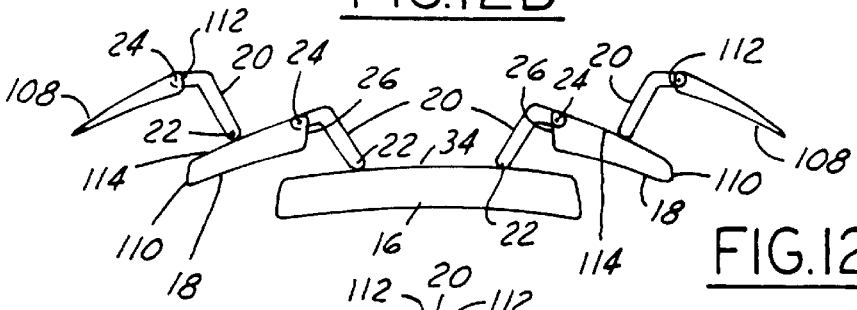
Figure 12D:
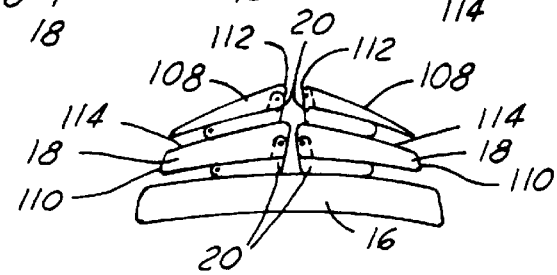

FIGS. 10, 11(*a*) and 11(*b*) illustrate an alternate linkage arrangement that may be used to coordinate joint motion during deployment between stowed and operational positions. FIG. 10 illustrates a segmented reflector 14, including a main body 16 and a pair of individual reflector segments 18. The reflector segments 18 are each connected to the main body 16 by three link members 90, 92, 94. The reflector is shown in a partially deployed position.

FIG. 11(*a*) is a partial view of the reflector 14 in its deployed position, and FIG. 11(*b*) is a schematic representations of the 4-bar linkage formed by the main body 16 and one of the reflector segments 18. Link member 1 and link member 3 of the linkage in FIG. 11(*b*) represent a portion of the main body 16 and one of the reflector segments 18 respectively. The lengths of the link members are schematically identified by $l_1$–$l_4$. The length ($l_4$) is the length of the link member 90, 94 and the length ($l_2$) is the length of the middle link member 92. In this embodiment the length ($l_4$) of the link members 90, 94 is the same as the length $\mathbf{1}_2$ of the link member 92.

The length ($l_1$) is the vertical distance between the line on which the first ends 96 of the link members 90 and 94 lie and the first end 98 of the link member 92. The length ($l_3$) is the vertical distance between the line on which the second end 100 of the link members 90, 94 lie and the second end 102 of the link member 94. The length of link members 1 and 3 represent the offset formed by the concave shape of these reflector portions 16, 18 between the joint locations. The linkage used in this embodiment is a unique implementation of the kind of 4-bar linkage known as a parallel mechanism. This type of linkage uses two sets of equal length links and keeps the reflector segments 18 essentially parallel to the main body 16 throughout the deployment motion, Alternatively, different link lengths may be used to achieve other deployment motions if needed.

While the embodiments shown and discussed above depict reflector segments 18 that are linked to the main body 16, FIGS. 12(*a*) through (*d*) illustrates how one or more reflector segments 108 may be linked to other reflector segments 18 by link members 20 instead of being linked to the main body 16. As shown in FIG. 12(*a*), the segmented reflector 14 includes a main body 16 and pair of reflector segments 18. The main body has a peripheral edge 28 located on either side for communication with a respective edge 26 of the first reflector segments 18. The first reflector segments 18 have a link member 20 that moves the segments from a stowed position shown in FIG. 12(*d*) to a deployed position shown in FIGS. 12(*a*) and (*b*). It should be understood that any number of link members may be utilized to move the segments to and from a stowed position.

The link members 20 each have a first end 22 attached to the rear surface 34 of the main body 16 and a second end 24 attached adjacent the edge 26 of the reflector segments 18. An additional pair of segments 108 have an edge 110 that is alignable with an edge 112 of the segment 18 with the edge 112 opposing the edge 26 of the segment 18. The first end 22 of the link member 20 is attached to the rear surface 114 of the segments 18 and the second end 24 is attached adjacent the edge 112 of the segment 108. The link members 20 operate collectively to move the segments 18, 108 such that in a deployed position a full reflector 14 is formed and in a stowed position, the segments 18 are stowed behind the rear surface 34 of the main body 16 with the link members 20 stowed therebetween and the segments 108 stowed behind the rear surfaces 114 of the segments 108 with the link members stowed therebetween.

It is to be understood that the preceding description of the preferred embodiment is merely illustrative of some of the many specific embodiments that represent applications of the principles of the present invention. Clearly, numerous and other arrangements can be readily devised by those of ordinary skill in the art without departing from the scope of the invention as defined by the appended claims.

What is claimed is:

1. A system for stowing and deploying a segmented dish-like structure, comprising:

a main body having a front surface, a rear surface, and an outer periphery;

at least one reflector segment having a front surface, a rear surface, and an edge that is alignable with a portion of said outer periphery of said main body to form the dish-like structure when said at least one reflector segment is in a deployed position;

at least one link member having a first end and a second end, said first end being secured to said rear surface of said main body and said second end being secured to said rear surface of said at least one reflector segment; and a mechanism for controllably moving said at least one link member from said deployed position to a stowed position wherein in the stowed position said at least one segment is disposed rearwardly of said main body with the front surface of said at least one segment pointing in substantially the same direction as the front surface of the main body and with said at least one link member disposed between said rear surface of said main body and said at least one reflector segment.

2. The system as recited in claim 1, wherein the segmented dish-like structure is an antenna reflector.

3. The system as recited in claim 1, wherein the segmented dish-like structure is a solar concentrator.

4. The system as recited in claim 1, further comprising:

a pair of dish segments, one of said segments alignable with a first portion of said outer periphery of said main body and the other of said segments alignable with a second portion of said outer periphery opposite said first portion.

5. The system as recited in claim 4 where said pair of segments overlap one another in said stowed position.

6. The system as recited in claim 1, further comprising:

an additional dish segment, having a front surface, a rear surface, and an edge that is alignable with a peripheral edge of said at least one segment; and a link member having a first end secured to said at least one segment and a second end secured to said additional segment, said link member disposing said additional segment rearwardly of said at least one segment in said stowed position.

7. The system as recited in claim 1, wherein two link members are utilized to interconnect said main body and said at least one segment.

8. The system as recited in claim 1, further comprising a rotary damper at least at one of said first or second ends of said link member to provide rate control.

9. A method for communicating a segmented dish-like structure from a deployed position to a stowed position, comprising:

providing a main body with a concave front surface, a rear surface, and at least one edge;

providing at least one segment having a concave front surface, a rear surface, and at least one edge;

providing at least one link member having a first end in communication with said main body and a second end in communication with said at least one segment;

pivoting said at least one segment about said first end from a position overlapping said main body wherein in the stowed position said concave front surface of said at least one segment points in substantially the same direction as said concave front surface of said main body; and pivoting said at least one segment about said second end to a position whereby said at least one edge of said at least one segment is in alignment with said at least one edge of said main body.

10. The method as recited in claim 9, wherein said at least one segment is stowed parallel to and in front of said main body.

11. The method as recited in claim 9, wherein said at least one segment is stowed parallel to and behind said main body.

12. The method as recited in claim 9, wherein said at least one link member comprises an inboard pulley, an outboard pulley, and a cable running therebetween to effectuate deployment and stowing of said at least one segment.

13. The method as recited in claim 9, further comprising:

three link members, each having a first end in communication with said main body and a second end in communication with said at least one segment to effectuate deployment and stowing of said at least one segment.

14. A segmented dish-like reflector for deployment from a stowed position to a fully operable position, comprising:

a main body having a front reflector surface, a rear surface, and at least one edge surface;

at least one reflector segment having a front reflector surface, a rear surface and at least one edge surface alignable with said at least one edge surface of said main body;

at least one link member pivotable about a first end in communication with said rear surface of said main body and pivotable about a second end in communication with said at least one reflector surface;

wherein said at least one link member pivots about said first end and said second end to move said at least one reflector segment between a deployed position with said at least one edge surface of said main body aligned with said at least one reflector segment and a stowed position wherein said body and said at least one reflector segment are overlapping and wherein in the stowed position said front reflector surface of said at least one reflector segment points in substantially the same direction as the front reflector surface of said main body.

15. The segmented dish-like reflector as recited in claim 14, wherein said at least one reflector segment is stowed in front of said front reflector surface of said main body.

16. The segmented dish-like reflector as recited in claim 14, wherein said at least one reflector segment is stowed behind said rear surface of said main body.

17. The segmented dish-like reflector as recited in claim 14, wherein said at least one link member further comprises an inboard pulley, an outboard pulley, and a cable running therebetween to effectuate deployment and stowing at least one segment.

18. The segmented dish-like reflector as recited in claim 15, further comprising:

three link members, a pair of outer link members and a middle link member each having a first end in communication with said at least one reflector segment, wherein said first ends of said outer link members lie in a place which is lower than a plane in which said first end of said middle member to effectuate deployment and stowing of said at least one segment.

19. The segmented dish-like reflector as recited in claim 14, wherein said at least one reflector segment further comprises a second peripheral edge surface positioned generally parallel to said first edge surface for alignment with an additional reflector segment which is in communication with said at least one reflector segment by a link member having a first end pivotally attached to said rear surface of said at least one reflector segment and a second end pivotably attached to a rear surface of said additional reflector surface.

* * * * *